United States Patent [19]

Vit et al.

[11] 4,185,672

[45] Jan. 29, 1980

[54] INTEGRATED TREE PROCESSING MILL

[75] Inventors: Rudy Vit, St. Nicolas; Igor Fridrich, Ste. Foy, both of Canada

[73] Assignee: Reed Ltd., Toronto, Canada

[21] Appl. No.: 637,668

[22] Filed: Dec. 4, 1975

[30] Foreign Application Priority Data

| | | | |
|---|---|---|---|
| Feb. 6, 1974 | [GB] | United Kingdom | 52890/74 |
| Jan. 27, 1975 | [GB] | United Kingdom | 3519/75 |
| Sep. 17, 1975 | [CA] | Canada | 235680 |

[51] Int. Cl.[2] ..... B27B 1/00

[52] U.S. Cl. ..... 144/312; 83/80; 83/160; 83/367; 83/368; 83/417; 144/3 R; 144/3 E; 144/39; 144/242 D; 144/242 H; 144/242 M; 144/326 R; 209/518; 364/469

[58] Field of Search ..... 144/312, 326 R, 1 R, 144/3 R, 3 E, 39, 242 R, 242 E, 242 D, 242 H, 242 M; 83/80, 158, 367, 160, 417, 368; 209/111.7, 73, 517, 518; 364/469

[56] References Cited

U.S. PATENT DOCUMENTS

| | | | |
|---|---|---|---|
| 3,456,700 | 7/1969 | Ahlsfedt | 144/312 |
| 3,459,246 | 8/1969 | Ottosson | 144/312 |
| 3,738,404 | 6/1973 | Walker | 144/39 X |
| 3,806,253 | 4/1974 | Denton | 144/312 X |
| 3,890,509 | 6/1975 | Maxey | 144/312 X |
| 3,903,771 | 9/1975 | Fritz et al. | 144/312 |
| 3,920,058 | 11/1975 | Walker | 144/39 X |
| 3,937,114 | 2/1976 | Joensson et al. | 144/312 |
| 3,960,041 | 6/1976 | Warren et al. | 144/39 X |

FOREIGN PATENT DOCUMENTS

| | | | |
|---|---|---|---|
| 730940 | 3/1966 | Canada | 144/312 |

*Primary Examiner*—Travis S. McGehee
*Assistant Examiner*—W. D. Bray
*Attorney, Agent, or Firm*—Swabey, Mitchell, Houle, Marcoux & Sher

[57] ABSTRACT

A process and apparatus are described wherein an integrated saw mill includes conveyor means for feeding debarked logs, classifying the logs and storing them according to size, advancing a particular log, scanning and analyzing the log and determining its cut pattern, squaring off the log by chipping heads, collectively cutting the log in line in accordance with the predetermined cut pattern, simultaneously advancing on separate conveyor means each piece of lumber so produced, sorting and storing each piece of lumber in accordance with its size, and further discharging the lumber onto a sticker-stacker for transferring stacks to drying kilns.

5 Claims, 13 Drawing Figures

108x
144x
108y
144y
108w
144w
L
158
156
154
152
148
144
147
108
192
140

INTEGRATED TREE PROCESSING MILL

BACKGROUND OF THE INVENTION

1. Field of the Invention

The present invention relates to an apparatus for converting trees into wood products, and more particularly, to a continuous process for handling, selecting and finishing trees into construction lumber, chips for pulp and other economic wood products.

2. Description of the Prior Art

It is well known to cut whole trees, delimb them and slash them into predetermined lengths at the tree site or nearby in a woodlands operation before transporting the trees to either a saw mill or a shipping plant for a paper mill. Such conventional woodlands operations, even though they have been highly mechanized and rendered more efficient of late, are still not without disadvantages. The labour and machinery required at the woodlands operation is still relatively expensive. Furthermore, much waste is left at the woodlands site in terms of branches. Furthermore, when the trees are slashed at predetermined lengths at the woodlands site, any selection of length is eliminated since there is little or no response at the woodlands site to the demands in terms of selective length. Further, the handling and transport of varied length logs is relatively more difficult.

In the saw mill operation, it has been found that much labour is required even in today's highly mechanized saw mills, particularly in selecting and sorting areas, and in areas of recycling of a particular log for cutting.

As the logs are fed into the saw mill, they vary considerably in size. These are normally stored and fed through chipping and sawing apparatus, and some attempts have been made to sort out the log sizes before chipping by means of manual scanning and operation of the gate which diverts the logs in at least two sizes, that is, large or small.

Saw mills have been developed whereby a log is cut in series according to a certain log pattern, and shipping heads are used for slabbing or for squaring the log before it is cut but the resulting lumber products, and these would seldom be of the same size from a given log, are then advanced and stored or accumulated together. Obviously, a further step of resorting, either mechanically or manually, is required to sort out the various pieces of lumber and stack the lumber according to size for later packaging and shipping.

SUMMARY OF THE INVENTION

It is an aim of the present invention to provide a highly integrated process for handling trees, wherein the trees are brought directly to the saw mill location whether whole or trimmed of branches and are handled in a continuous process using the maximum of mechanical and electronic apparatus and reducing manpower requirements and increasing the capacity of output as well as efficiency of the plant.

It is a further aim of the present invention to provide storage banks in series wherein logs entering the saw mill can be stored according to their size (diameter) after they have been debarked, and further storage banks are provided after the sawing operation for selectively storing the lumber so produced by their size so as to facilitate the handling thereof.

A process in accordance with the present invention includes the steps of delimbing and debarking the trees, advancing the so-formed logs past a scanning station, scanning the logs to determine the respective diameter of the logs, passing the trees past a plurality of storage banks along a path, diverting the logs from the path into the respective storage banks classified according to its respective diameter, selectively withdrawing logs from the log storage banks, predetermining the cutting pattern for the respective logs, squaring off the logs, advancing the squared off logs past a sawing station, whereby the saws and chipping heads have been adjusted according to the cutting pattern, advancing the wood products so formed simultaneously in separate paths, edging the boards so formed where necessary, diverting the wood products so formed in separate wood products storage banks according to respective size of the wood product formed.

An apparatus in accordance with the present invention includes an integrated system having a delimbing means, debarking means, conveyor means for advancing the debarked logs so formed, means for scanning the logs to determine the respective diameter of the logs, a plurality of storage banks extending laterally to the path of the conveyor, kick-off gates adjacent the conveyor belt at each storage bank, means for activating a predetermined kick-off gate according to the information received from the scanning means so as to throw up logs in accordance with their respective diameters in separate storage banks, second conveyor means extending parallel to the first conveyor means but at the other end of the storage bank, means for unloading logs from a predetermined storage bank onto the second conveyor means, memory means including information regarding a plurality of cutting patterns, means for determining which cutting pattern is to be utilized, chipping means for squaring off the logs so formed, in-line sawing means for successively cutting the log in accordance with the predetermined cutting pattern, a plurality of parallel conveyor means adjacent each sawing device to advancing the wood products so formed at said sewing devices, means for advancing the logs on the conveyor means towards a plurality of storage banks extending laterally of the conveyor means, means for diverting the so-formed wood products in respective storage banks according to the size of the wood products so formed.

In the process in accordance with one aspect of the present invention, the tree lengths having been felled may be brought directly to a loading deck in load bundles, then passed in bundles through a tree delimber, and then slashed into selected lengths and passed through debarking drums. The branches and bark are discharged from the drums and are fed to a heater or furnace as fuel for the heating plant and boiler requirements.

The trees may have been debarked whole and then in turn slashed to selective lengths depending on input factors of demand and tree characteristics. The slashed logs then pass through selection areas where relatively small, crooked or otherwise unacceptable logs can be diverted to a whole chipping unit for making pulp chips while the other logs are passed on to further scramblers. Logs may also be selected and diverted if they are big enough for making veneer. The remaining logs are diverted selectively according to their diameter and/or length into a series of storage banks. Each log is aligned and passed through edge chippers for squaring off the logs by passing through a first scanner for providing data to a computer which adjusts the spacing of the edge chippers and the subsequent band saw arrangements and to determine the sawing pattern. The log is squared and sawed in a single in-line operation with diversion of chips to a pulping mill. The lumber products are selectively stored in lumber collecting banks depending on the size of the wood product.

In a more specific embodiment of the present invention, there is provided a transfer mechanism for transferring and centering lumber which includes a carriage adapted to move from a first position to engage an article to be transferred and to a second position on a moving path whereby it centers the article on the moving path, the carriage including a pair of scissors-type pivoting arms mounting gripping and centering rollers, and means for sliding the carriage from the first position to the second position, and means for operating the arms to grip the article in the first position and to release and center the article in the second position.

In a further more specific embodiment, there is provided emergency discharge means for discharging elongated articles from an open transfer device wherein the open transfer device includes longitudinal spaced-apart conveyor means for advancing an elongated article, a reciprocating frame mounted underneath the transfer mechanism mounting driven conveying means, the reciprocating frame adapted to move between a first position below the level of a transfer conveyor and a second position where the driven conveying means extends above the plane of the transfer conveyor so as to engage the elongated articles and move them laterally from the transfer conveyor.

In a still more specific embodiment of the present invention, there is provided a storage system which includes a plurality of storage banks extending transverse to the longitudinal direction of the path of travel of the lumber to be stored, a plurality of conveyor sections, one corresponding to each bank and extending in the longitudinal direction of the path of the lumber, and means spaced above the storage means, diverting means including means for lifting or moving a corresponding conveyor section whereby the oncoming lumber products will be made to fall into the storage banks under the conveyor section which has been moved, each conveyor section infeed end being slightly lower than the outfeed end of the adjacent upstream conveyor, successive downstream conveyor sections being driven at a slightly lower speed whereby when the wood products are advanced in close formation, they are allowed to overlap at the ends thereof with the upstream piece overlapping the adjacent end of the downstream piece such that when the lumber product arrives at the discharge into a bank, it falls in a substantially parallel manner in view of the weight of the upstream lumber product overlapped on the end thereof.

A further feature of the present invention includes a control system which includes a first scanning means at the infeed of the logs, input data receiving means for interpreting the data received from the first scanning means and for measuring the logs and for sorting the logs according to size, means associated with said control system for activating diverting means relative to the log storage bank whereby the logs are stored according to size, and diverting means controlled by the control system based on said data to divert logs to a whole chipper, second scanning means for scanning the logs as they advance from a selected storage bank, input data receiving means for interpreting and controlling the chipper mechanism and saws according to a predetermined cut pattern stored in a memory, means for controlling the board edgers dependent on the input to said second scanning means, means for adjusting and controlling the feed of each conveyor section as it advances in the lumber products storage banks, and means for diverting the lumber products according to the input interpreted to said second scanning means for selectively storing pieces of lumber in accordance with its size.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
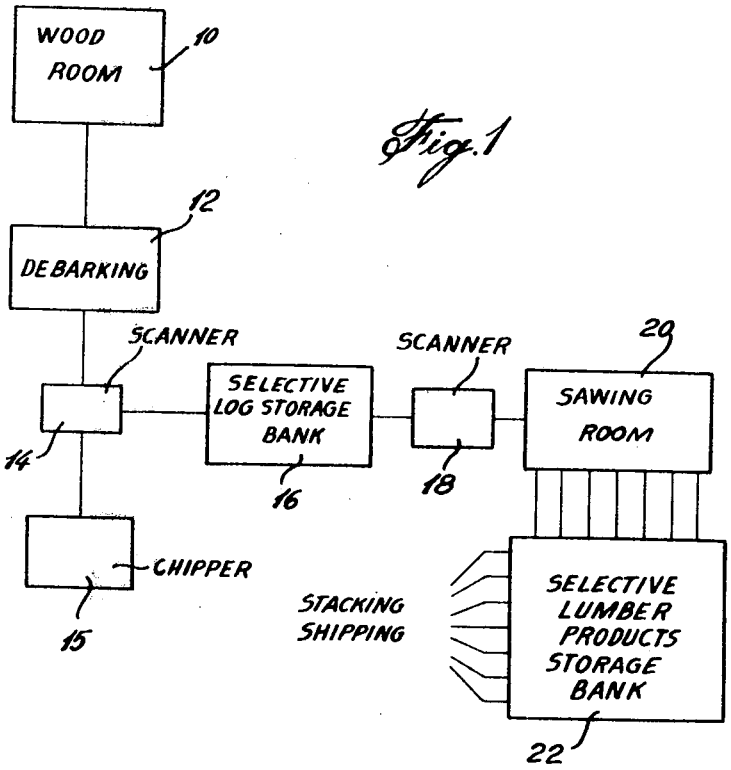
FIG. 1 is a diagram illustrating the various steps of a continuous process.

Referring now to the drawings, and particularly to FIG. 1, there is shown an integrated processing mill for converting trees T into wood products, such as a construction lumber L and other useful wood products. An embodiment of the integrated processing mill includes a woodroom 10 for receiving the trees, a debarking station 12 for removing the remaining bark from the trees which have been delimbed, and a scanner 14 for measuring the logs so formed and for classifying the logs according to size for storage in the selective log storage banks 16. A further scanner 18 may be provided for again measuring the logs from the storage bank to predetermine the cutting pattern for the chipping and sawing room 20. Various wood products are then individually advanced to the lumber products storage bank, and from the storage banks the classified sorted lumber products can be withdrawn for kiln drying or for shipping.

Figures 2, 11:
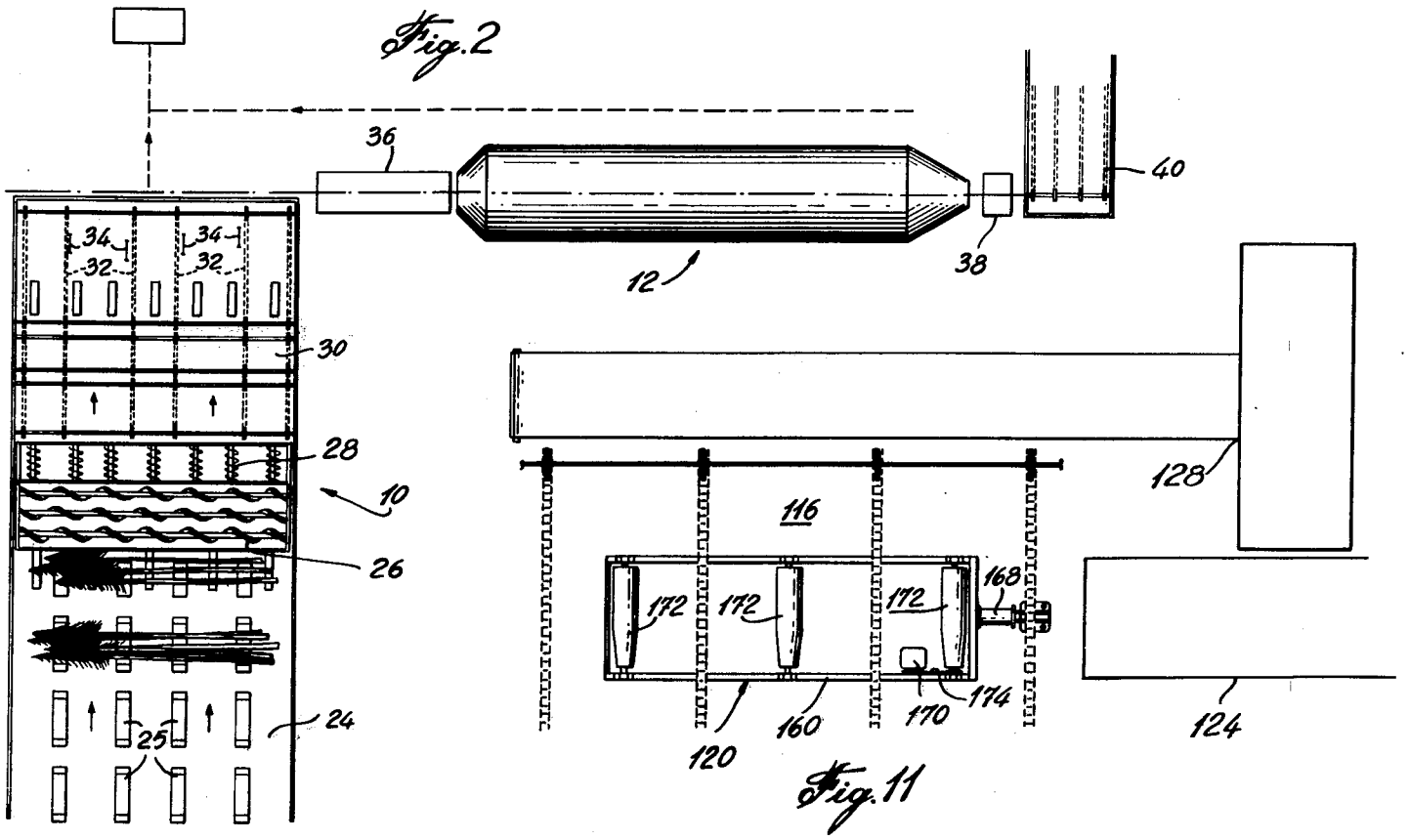
FIG. 2 is a top plan view, partly diagrammatic, of an embodiment of a woodroom and debarking portions of the system.
FIG. 11, which is on the same sheet as FIG. 2, is a top plan view of the details shown in FIGS. 9 and 10.

FIG. 2 shows an embodiment of a woodroom 10 which includes a loading station 24 which shows bundle conveying means 25 adapted to receive complete loads of trees dumped onto the loading station 24. This bundle may represent a complete truck load of cut trees which still have their branches. The bundles of trees are advanced towards the delimbing station 26.

The delimbing station typically includes three laterally extending screw-type cutting means; preferably each individual cutting means floats independently and at least one would have its screw spirals in an opposite direction. The bundles are dumped into the delimbing station, and the limbs are cut or broken by means of the screw cutting means.

A plurality of screw-type conveying means 28 pick up the delimbed trees one by one from the delimber station 26 and advance them towards a conveying and slashing table 30. The table 30 includes conveying chains 32 with upstanding abutment devices for advancing the trees which are now shorn of any branches. The trees are passed over a series of driven rollers which are meant to align the trees in axes normal to the forward path of the tree and then the trees are passed over slashing saws 34 which cut the tree length into predetermined log lengths.

The logs are then passed, if necessary, through a deicing chamber 36 which might include a water bath and then are fed into the debarking drum 12. Feed rollers 38 engage the debarked logs as they come out the debarking drum and advance the logs onto a conveying table 40 with chains.

Figure 3:
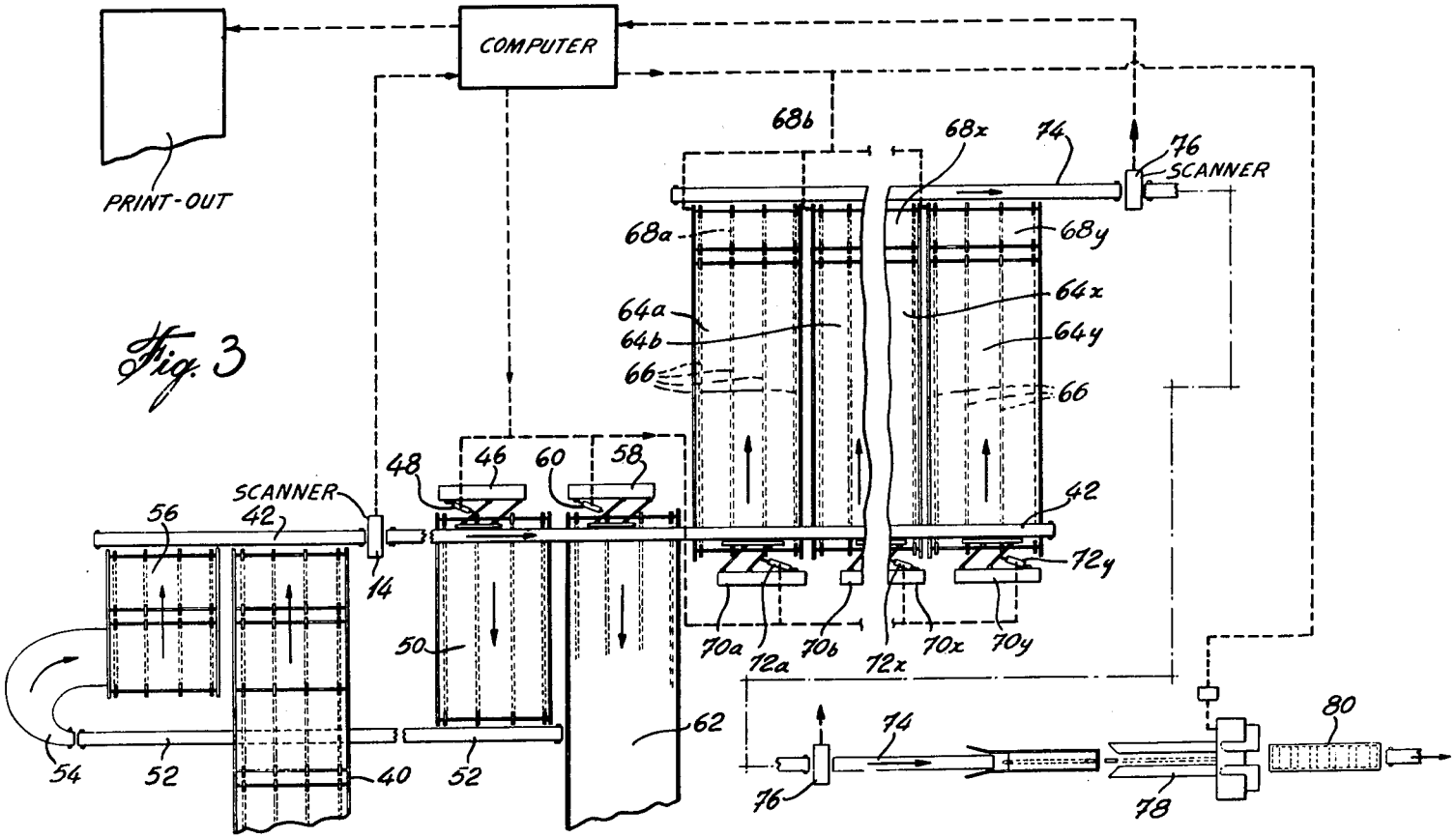
FIG. 3 is a top plan view of the first scanner and the log storage bank.

The conveyor 40 advances the logs which extend laterally along a longitudinal path to the belt conveyor 42 illustrated in FIG. 3.

Each log, as it advances on the conveyor 42, passes the scanner 14. The scanner 14 measures the size and bowing of the log advancing on the conveyor 42, and the data is fed into the computer. The scanner also obtains information as to whether the log is advancing with its small end or with its larger end first. If the log is advancing with its larger end downstream, this should be reversed because it is preferable that the logs enter the saw mill room 20 with its small end first. Accordingly, a signal will be sent to the piston and cylinder 48 of the kick-out gate 46 thereby knocking the logs onto the transfer conveyor 50 which feeds the logs one by one onto the belt conveyor 52. The conveyor 52 will advance the logs to be turned to a reversing chute 54 which will feed the log, after it has been reversed, onto the transfer conveyor 56. The transfer conveyor and unscrambler 56 will advance the so-turned logs back onto the conveyor 42 with its small end downstream. Other information picked up by the scanner 14 and fed to the computer includes length and taper dimensions.

If the logs advancing on the conveyor 42 are determined to be of a diameter which is too small for conversion into lumber or other useful wood products or if it is considered otherwise unsuitable by the computer, such as instruction signal will be sent to the cylinder and piston 60 of the kick-out gate 58 to activate the gate to divert the logs onto the transfer conveyor 62. The transfer conveyor 62 will advance the logs so diverted through a chipping head which is adapted to convert the complete log into chips suitable for paper manufacture or chipboard manufacture or other uses.

Although it is not shown in FIG. 3, a further transfer conveyor with associated kick-out gate can be provided for diverting very large logs which might be suitable for the manufacture of veneer.

If the logs are considered to be of a size suitable for the wood products process, they advance along conveyor 42 towards the storage banks 64. A number of storage banks from one to an indefinite number can be provided, and the computer will be programmed to classify the logs depending on the information received from the scanner 14. The kick-out gates 70*a*, 70*b* . . . 70*x*, 70*y* will be instructed by a signal from the computer as a log advances to divert the log into a transfer conveyor representing the storage bank according to the diameter of the log. Each kick-out gate 70*a*, 70*b* . . . 70*x*, 70*y* includes a piston and cylinder arrangement 72*a*, 72*b* which will be activated by a signal from the computer. The storage banks 64*a*, 64*b* . . . 64*x*, 64*y* include a regular transfer conveyor for advancing the logs with their axes extending laterally to the advancing feed path whereby the logs can be stored, and an unscrambler 68*a*, 68*b* . . . 68*x*, 68*y* is respectively provided at the end of each storage bank 64 for feeding the classified logs one by one onto a conveyor 74 as instructed by the computer. As a given size of log is being withdrawn from the storage bank 64 by means of the unscrambler 68, the logs will pass through a second scanner 76 which will confirm to the computer the size of the log and the computer will predetermine a cut pattern which is programmed in the memory, and signals will be provided to the various chipping and sawing equipment, which will be described further, according to the cut pattern selected. The cut pattern is determined by market demand, economic recovery, log diameter, length, taper, and diameter compensation in case of log bowing.

Figure 4:
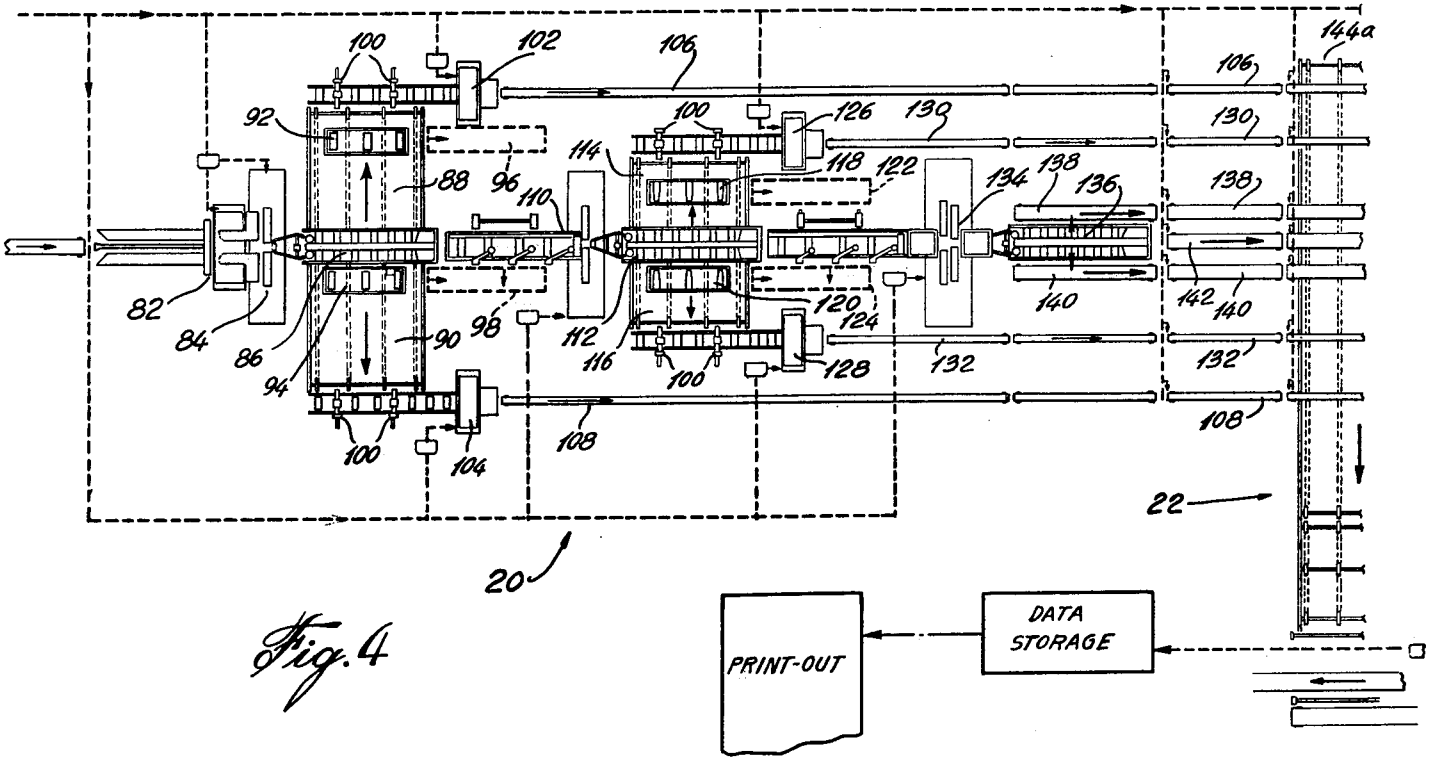
FIG. 4 is a top plan view, partly diagrammatic, of the chipping and sawing room.

As the log advances along conveyor 74, as shown in FIG. 3, it will approach a chipper canter 78 which will provide two flattened faces to the log, and the log will then advance onto a flipping table 80 such that the flat faces are the top and bottom of the log. The log may advance into the sawing room 20 as shown in FIG. 4, and a log chipper edger 82 will square off the remaining faces of the logs being advanced.

A twin band saw 84 may be provided downstream of the chipper 82 to cut off the first two pieces of lumber from the squared off logs according to the predetermined cut pattern. These pieces may be boards of predetermined size, and they are then diverted onto transfer tables 88 and 90 by means of the splitter table 86. As the boards advance in opposite directions along tables 88 and 90 which include chain conveyors, they may be gripped by respective gripping and centering devices 100 which will be described in more detail, and fed onto the advance table of the board edge chippers 102 and 104 respectively.

Each board L, which is squared off at its edges by the board edge chippers 102 and 104, is advanced along respective belt conveyors 106 and 108 towards the wood products storage bank 22. The logs are received through different combinations of chipping heads and/or saws which might be band saws or circular saws which are spaced in accordance with the cut pattern selected by the computer.

A typical band saw is also located at 110, and two further boards may be produced and then diverted onto the transfer chain conveyor tables 114 and 116, and again the gripping and centering devices 100 move the respective boards L and they will be advanced through the respective edge chippers 126 and 128 and finally on the conveyors 130 and 132 towards the storage banks 22.

Finally, a multi-saw device 134 may be provided for finishing the cutting of the logs to boards L, and a splitter 136 will divert two further boards L onto conveyors 138 and 140 while the remaining board can advance along the conveyor 142 towards the storage banks 22.

Figure 5:
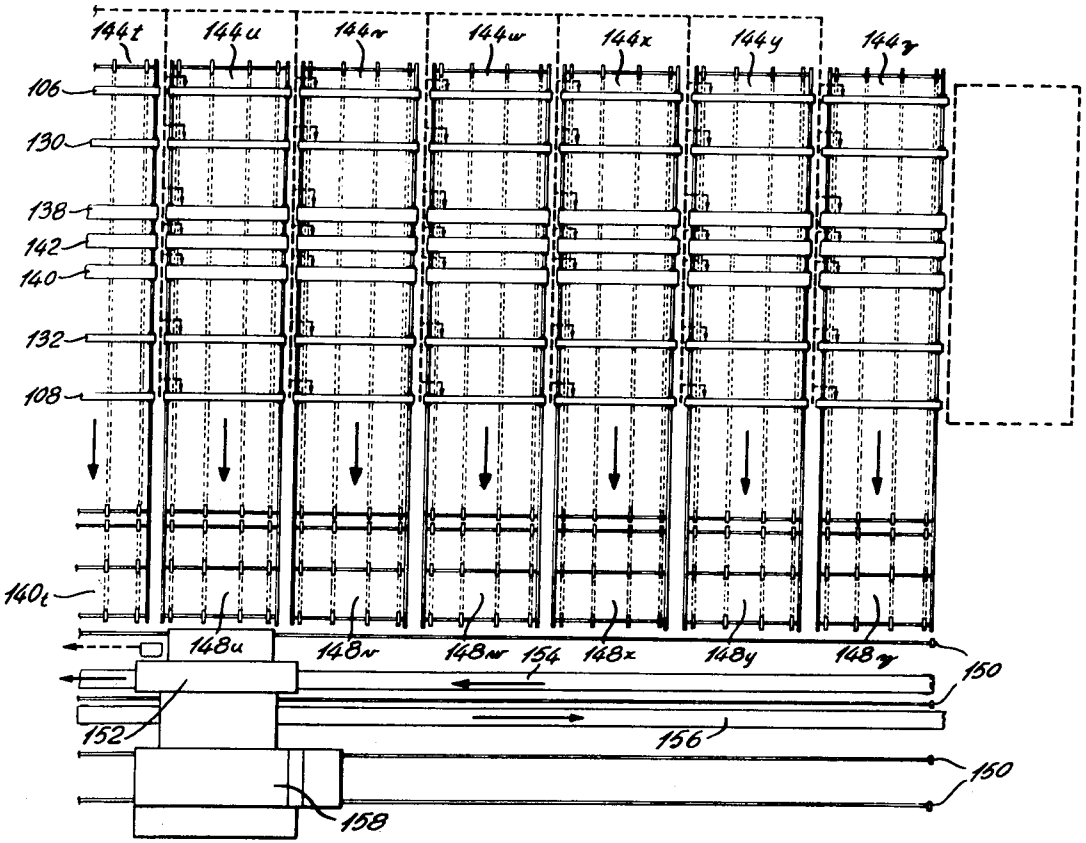
FIG. 5 is a fragmentary top plan view of the wood products storage bank.

FIG. 5 illustrates a typical number of storage banks 144 which are similar to the log storage banks 64 in that they are made up of a chain conveyor table which slowly advances the wood products towards the unscramblers 148.

Figures 6, 7, 8:
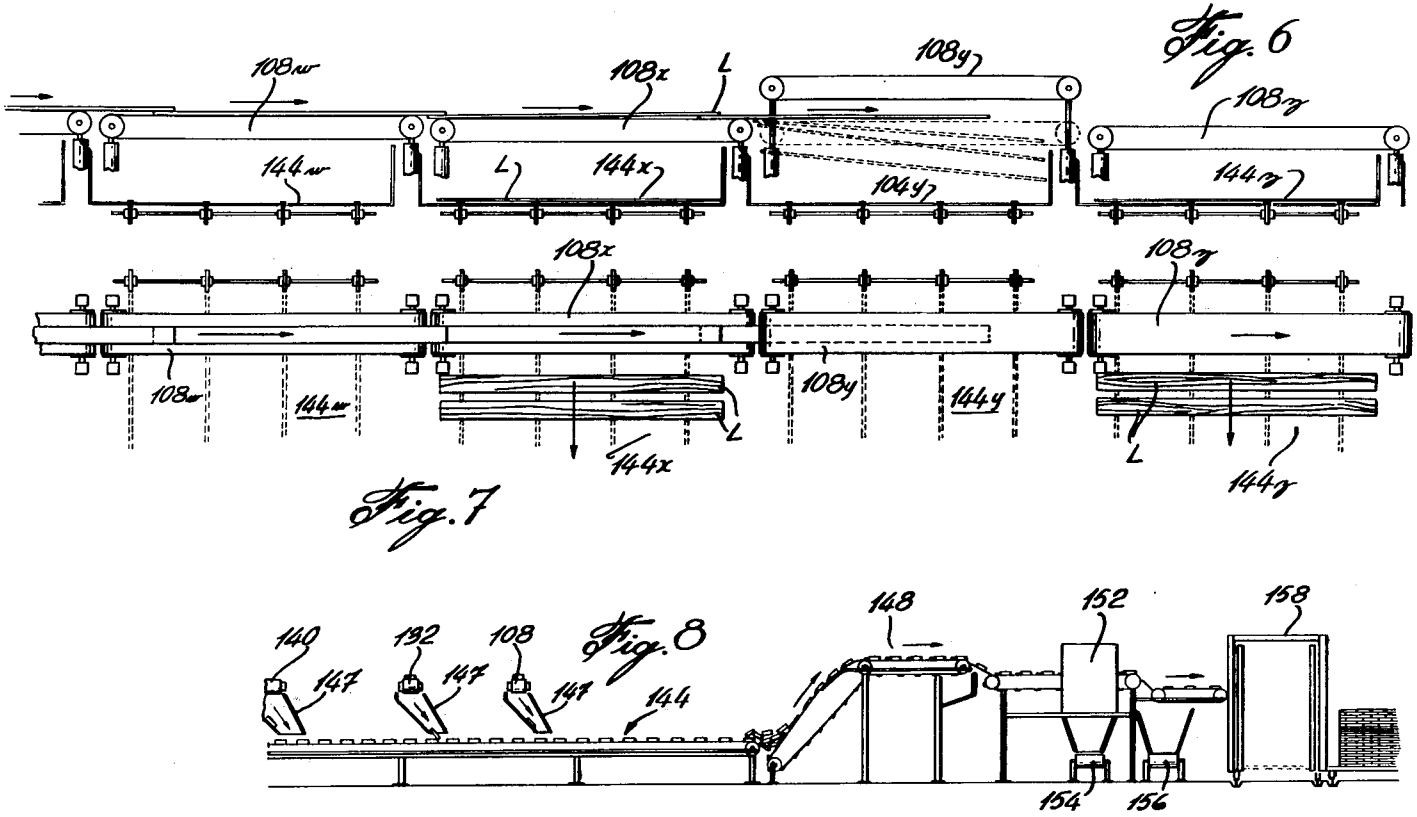
FIG. 6 is a side elevation of a detail of the apparatus shown in FIG. 5.
FIG. 7 is a detail top plan view of the apparatus shown in FIG. 6.
FIG. 8 is an elevational view of a further aspect of the apparatus shown in FIG. 5.

The speeds of the conveyors 106–142 and the conveyors in storage banks 144*a* . . . 144*z* may be controlled by the computer. Each conveyor 106, 108, 130, 132, 138, 140 and 142 is made up, over the storage banks 144, of individual independently supported or suspended conveyor sections. A typical conveyor 108 is shown in more detail in FIGS. 6 and 7 wherein each conveyor section 108*w*, 108*x*, 108*y*, 108*z* can be driven by a variable speed motor such that each downstream successive conveyor section moves at a slightly slower speed than the upstream section, and the infeed end of each conveyor section 108*w*, 108*x*, 108*y* and 108*z* is slightly lower than the outfeed end of the upstream conveyor section such that the boards, when they are advancing in close order, overlap each other at the ends thereof. If the same size board L is advanced on the conveyor 108, a section 108*y* over the storage bank 144*y* is raised so as to allow the boards L to fall onto the storage bank 144*y*. Since the boards are overlapped as shown in FIG. 6, the board L being discharged will tend to remain horizontal until close to the full length of the board is over the conveyor table of the storage bank 144*y* such that the board will fall parallel onto the conveyor. Chutes 147 may also be utilized to direct the boards onto the conveyor.

In FIG. 8, there is illustrated a typical storage bank 144. The accumulator 148, when activated, will advance the boards, all of the same size, from the bank 144 into the board trimmer 152. As shown in FIG. 5, the board trimmer 152 is adapted to travel on the tracks 150, and the left-overs from the trimming will fall on the conveyor 154 while the lumber which may be too short will fall on conveyor 156. Finally, the sticker-stacker apparatus 158 is provided on adjacent tracks 150 in line with the trimmer for receiving the boards and stacking them for kiln drying.

Figure 9:
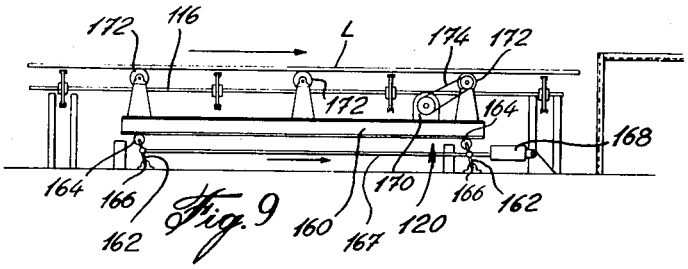
FIG. 9 is an elevational view showing a detail of the apparatus shown in FIG. 4.
Figure 10:
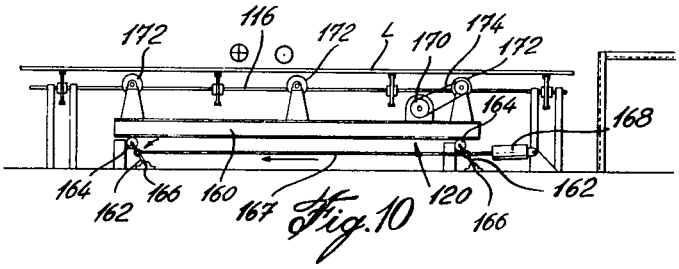
FIG. 10 is an elevational view similar to FIG. 9 showing the apparatus in a different operating position.

FIGS. 9, 10 and 11 illustrate a so-called emergency conveying means 120. In FIG. 4, there is shown emergency conveying means 92 and 94, 118 and 120 under each transfer conveyor 88, 90, 114 and 116 respectively. The details shown in FIGS. 9, 10 and 11 are of a typical conveyor 120. The conveyor 120 will include platform 160 which is normally in the position shown in FIG. 10 mounted on legs 162 adapted to pivot about pivot joints 166 while the table is mounted by pivot joints 164. A piston 167 is connected to the legs 162, and when actuated by the cylinder 168, the platform 160 will be raised such that the conveyor rollers 172 will protrude above the chain conveyor table 116. At least one of the rollers 172 is driven by driving belt 174 connected to a motor 170. The rollers 172 are typically conically shaped such as shown in FIG. 11 so that the boards advancing on the table 116 can be engaged by the rollers 172 and advanced into the emergency storage bank 124. These emergency conveyors 92, 94, 118 and 120, are operated when there is a jam-up along the line, which might be caused by mechanical failure or otherwise, so as to prevent a more serious jamming of the lumber products advancing along the line. Such conveyors could be inserted in the in-line conveying systems, but the rollers would have a spiral rib in order to divert the lumber sideways.

Figure 12:
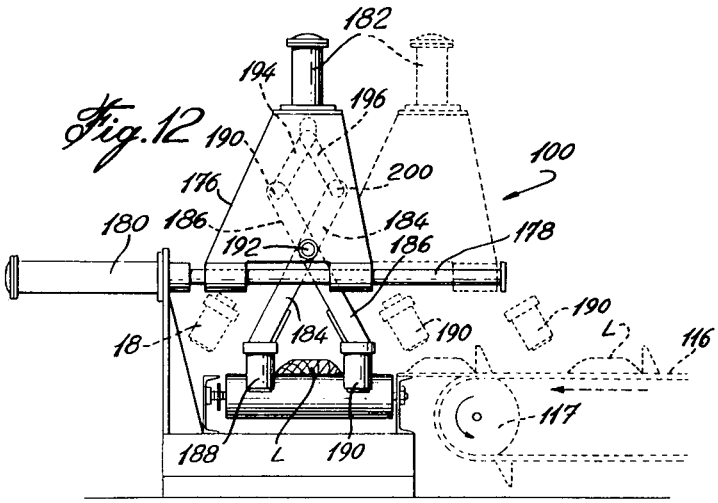
FIG. 12 is an elevation of a further detail of the apparatus shown in FIG. 4.

In FIG. 12 there is illustrated a gripping device for gripping the wood products L advancing on a typical transfer table 116. The gripping device 100 includes a carriage 176 mounted on a piston 178 actuated by a cylinder 180. A piston 182 activates a pair of arms 184 and 186 pivoted about axis 192 connected to links 194 and 196 by means of pivots 198 and 200. The cylinder 182 actuates the links 194 and 196 to either open or close the gripper arms 184 and 186. The gripper arms 184 and 186 also mount rollers 188 and 190. When the carriage is in the position shown in dotted lines, the cylinder 182 is activated in order that the rollers 188 and 190 grip a board being advanced along the conveyor 116. Then, the cylinder 180 is activated to move the carriage so that it is central of the conveying means for the board edger, as shown in full lines. The cylinder 182 is then activated to open the gripper means and clear the board as the carriage is moved back to the position shown in dotted lines. The cylinder closing the gripping arms is provided with pressure compensating means since the width of the boards will vary as well as the taper thereof.

Figure 13:
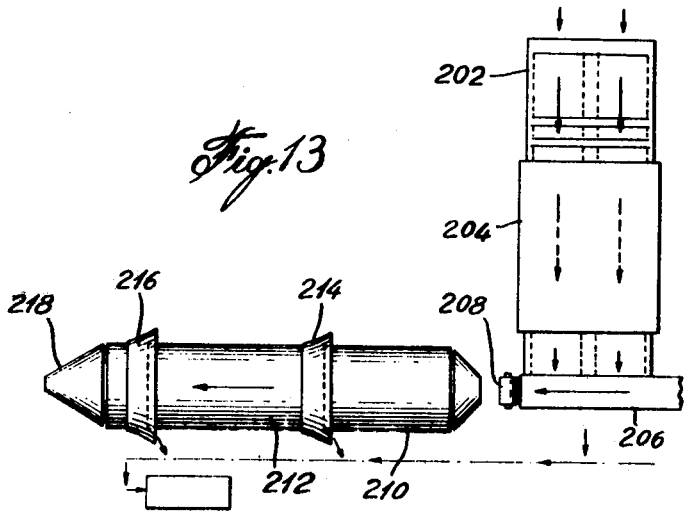
FIG. 13, which is on the same sheet as FIG. 1, illustrates a further embodiment of the woodroom and debarking stations of the process.

FIG. 13 shows another embodiment of the woodroom and debarking means. In this case, the full length trees are dropped on the loading platform 202 and advanced to a de-icing chamber 204 in which a water bath or spray is provided. The trees are then advanced to a conveyor 206, fed at a high speed by conveyor rollers 208 into a double axially aligned drum 210 and 212. The accelerated speed can reach 700 feet per minute. The drums 210 and 212 may be made of more than one drum section rotating at different speeds. The first drum section which will be fully closed includes the normal debarking ribs on the inside which can be somewhat adapted for the particular type of debranching that must be done in this stage. The branches would be discharged through the flared discharge port 214 between the drums. The second stage illustrated at 212 would be a first debarking stage on a drum, and the bark would be discharged through a similar flared discharge port 216 at the end thereof. More than one debarking drum could be provided depending on the length of the tree.

The bark and branches would be collected on conveyor belts and conveyed through a processing unit for preparation into fuel, for instance.

We claim:

1. A method of producing wood products from trees, including the steps of delimbing and debarking the trees, advancing the so-formed logs past a scanning station, scanning the logs to determine the respective diameter of the logs, passing the trees past a plurality of storage banks along a path, diverting the logs from the path into the respective storage banks classified according to its respective diameter, selectively withdrawing logs from the log storage banks, predetermining a longitudinal cutting pattern for the respective logs, squaring off the logs by means of chipping heads, advancing the squared off logs through a sawing station including saws, whereby the saws and chipping heads have been adjusted according to the predetermined cutting pattern for forming the logs into wood products, advancing the wood products so formed simultaneously in separate paths, edging the boards so formed where necessary, diverting the wood products so formed in separate wood products storage banks according to respective size of the wood product formed.

2. Apparatus for sawing logs into lumber products, including means for retrieving a log from a log storage bank and advancing the log along an in-line conveyor, means for scanning said log, input data receiving means for interpreting the data received from the scanning means and determining a sawing pattern, a plurality of chipper and sawing means for squaring off a log and for cutting the squared-off log in accordance with the sawing pattern, said chipper and sawing means being in line along the path of the advancing logs, said data receiving means including means for controlling the positioning of the chippers and sawing means according to the sawing pattern, transfer means at each sawing station for removing the sawed-off finished board or lumber product from the in-line advance of the remaining logs, said transfer means including conveyor means for advancing each wood product on either side of the sawing station, means for picking each product on the transfer means and centering it on an in-line conveyor and a board edge chipper, longitudinally extending parallel conveyor means associated with each board edge chipper for advancing the finished wood product towards a storage system, and apparatus for storing wood pieces, such as debarked logs or finished lumber, including means for advancing the wood pieces along a predetermined longitudinal path, a plurality of laterally extending storage banks adjacent the longitudinal paths, means for scanning the wood pieces to determine the respective size of the wood pieces, and means associated with said paths for diverting wood pieces from the paths into the storage banks according to data received from said scanning means.

3. An apparatus as defined in claim 2, wherein the means for advancing the wood pieces include a conveyor, and pivoting diverting gates are provided above the conveyor for diverting the wood pieces from the conveyor into the storage banks.

4. An apparatus as defined in claim 2, wherein the storage banks include elongated tables on which the wood pieces can be advanced by advancing means associated with the table, with the axes of the wood pieces in a lateral extent relative to the direction of advance in the storage banks, and conveyor means are provided at the other end of the storage banks for advancing the wood pieces in line from a predetermined selected bank.

5. An apparatus as defined in claim 2, wherein there is provided a plurality of storage banks, each storage bank having advancing means for advancing the wood pieces, such as finished lumber, with the axes of the wood pieces extending laterally of the direction of advance in the storage banks, there being a plurality of longitudinally conveying means advancing the pieces in line over the storage banks, each longitudinal conveying means including a plurality of sectioned conveyor belts independently driven, each section being adapted to be raised above the longitudinal path of the conveyor belt, each downstream section being driven at a speed slightly lower than the upstream section and each section being in plane slightly lower than the upstream section such that the wood pieces, as they are advanced, overlap with the leading end of the upstream piece over the trailing end of the downstream piece, such that when a wood piece arrives over a predetermined storage bank where the conveyor section has been lifted, the wood piece will be caused to fall parallel onto the storage banks.

* * * * *